US007036177B2

(12) United States Patent
Aouad et al.

(10) Patent No.: US 7,036,177 B2
(45) Date of Patent: May 2, 2006

(54) DISPENSING OF RINSE ADDITIVES INTO THE RINSE CYCLE DURING AUTOMATIC MACHINE LAUNDERING OF FABRICS

(75) Inventors: Yousef Georges Aouad, Cincinnati, OH (US); Arthur Hampton Neergaard, Cincinnati, OH (US); James Douglas Still, Cleves, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 525 days.

(21) Appl. No.: 10/366,204

(22) Filed: Feb. 13, 2003

(65) Prior Publication Data

US 2003/0172960 A1 Sep. 18, 2003

Related U.S. Application Data

(60) Provisional application No. 60/356,544, filed on Feb. 13, 2002.

(51) Int. Cl.
*D06F 39/02* (2006.01)

(52) U.S. Cl. ..... 8/159; 68/17 R; 68/207

(58) Field of Classification Search ..... 8/159; 68/17 R, 17 A, 207; 122/80, 129, 132
See application file for complete search history.

(56) References Cited

U.S. PATENT DOCUMENTS

| | | | | |
|---|---|---|---|---|
| 3,028,051 | A * | 4/1962 | Jacobs | 222/41 |
| 3,044,667 | A * | 7/1962 | Lucas | 222/454 |
| 3,180,538 | A * | 4/1965 | Brown et al. | 222/500 |
| 3,212,675 | A * | 10/1965 | Krzewina | 222/652 |
| 3,220,607 | A * | 11/1965 | Seal | 222/54 |
| 3,988,908 | A | 11/1976 | Beare et al. | |
| 4,026,131 | A | 5/1977 | Dugger et al. | |
| 4,186,573 | A | 2/1980 | Brenner et al. | |
| 4,260,054 | A | 4/1981 | Bory et al. | |
| 4,265,372 | A | 5/1981 | Wainberg | |
| 4,379,515 | A | 4/1983 | Towsend | |
| 4,416,791 | A | 11/1983 | Haq | |

(Continued)

FOREIGN PATENT DOCUMENTS

| | | |
|---|---|---|
| CA | 1133712 | 10/1981 |

(Continued)

*Primary Examiner*—Frankie L. Stinson
(74) *Attorney, Agent, or Firm*—Julia A. Glazer; Kim William Zerby; Steven W. Miller

(57) ABSTRACT

Disclosed are systems, methods, devices and kits for the timed dispensing of laundry rinse additive materials into the drum of an automatic washing machine as that machine is used to carry out a fabric laundering operation. To bring about such dispensing of rinse additives, a housing structure device is placed within the drum of an automatic washing machine, a unit dose insert package, containing laundry rinse additives in at least one compartment of the insert, is placed within the housing structure, and the machine is run through the several stages of its laundering cycle. Means are provided to open at least one rinse additive-containing compartment of the insert later in the laundering cycle to dispense contents of this compartment into the washing machine drum as rinse additive materials. The means for opening such compartments of the insert are activated by centrifugal force arising during the spin cycle of the laundering operation. This spin cycle centrifugal force also holds the contents of the opened insert compartment(s) within the structure until the rinse cycle of the laundering operation, whereupon those contents are dispensed from the housing structure into the washing machine drum.

23 Claims, 7 Drawing Sheets

U.S. PATENT DOCUMENTS

| | | | | | |
|---|---|---|---|---|---|
| 4,429,812 | A | | 2/1984 | Steiner et al. | |
| 4,588,080 | A | | 5/1986 | Ginn | |
| 4,700,857 | A | | 10/1987 | Kittscher et al. | |
| 4,882,917 | A | | 11/1989 | Mizusawa et al. | |
| 4,982,467 | A | | 1/1991 | Mizusawa et al. | |
| 5,033,643 | A | | 7/1991 | Schumacher | |
| 5,061,807 | A | | 10/1991 | Gethöffer et al. | |
| 5,129,120 | A | | 7/1992 | Cornette et al. | |
| 5,133,487 | A | | 7/1992 | Russi | |
| 5,176,297 | A | | 1/1993 | Mooney et al. | |
| 5,531,081 | A | * | 7/1996 | Savkar et al. | 68/17 A |
| 5,536,421 | A | | 7/1996 | Hartman et al. | |
| 5,687,588 | A | | 11/1997 | Azzani et al. | |
| 5,732,853 | A | | 3/1998 | Ganzeboom et al. | |
| 5,792,219 | A | | 8/1998 | Hartman et al. | |
| 6,138,693 | A | | 10/2000 | Matz | |
| 6,179,167 | B1 | | 1/2001 | Boot et al. | |
| 6,203,535 | B1 | | 3/2001 | Barney et al. | |
| 6,281,183 | B1 | | 8/2001 | Harbour | |
| 6,352,158 | B1 | | 3/2002 | Cole-Bennett et al. | |
| 6,378,274 | B1 | | 4/2002 | Harbour | |
| 6,439,387 | B1 | | 8/2002 | Bergman | |
| 6,571,993 | B1 | * | 6/2003 | Rodd et al. | 222/444 |
| 6,581,800 | B1 | * | 6/2003 | Rodd et al. | 222/54 |
| 2001/0049846 | A1 | | 12/2001 | Guzzi et al. | |
| 2002/0078589 | A1 | | 6/2002 | Hagemann et al. | |
| 2002/0088502 | A1 | | 7/2002 | Van Rompuy et al. | |
| 2002/0100773 | A1 | | 8/2002 | Rodd et al. | |
| 2002/0108969 | A1 | | 8/2002 | Rodd et al. | |
| 2003/0182732 | A1 | | 10/2003 | Davenet et al. | |

FOREIGN PATENT DOCUMENTS

| | | | | |
|---|---|---|---|---|
| DE | 36 09 875 | | * | 9/1977 |
| DE | 39 22 342 | | * | 1/1991 |
| DE | 39 22 342 | A1 | | 1/1991 |
| DE | 39 34 123 | A1 | | 4/1991 |
| DE | 101 14 256 | A1 | | 3/2001 |
| DE | 19945849 | A1 | | 3/2001 |
| EP | 0 215 366 | B1 | | 10/1988 |
| EP | 0 351 671 | | | 7/1989 |
| EP | 1 195 350 | | | 4/2002 |
| WO | WO 94/07979 | A1 | | 4/1994 |
| WO | WO 96/26312 | | | 8/1996 |
| WO | WO 97/09480 | | | 3/1997 |
| WO | WO 00/02982 | | | 1/2000 |
| WO | WO 00/02987 | | | 1/2000 |
| WO | WO 00/29537 | | | 5/2000 |
| WO | WO 00/49218 | | | 8/2000 |
| WO | WO 01/07702 | A1 | | 2/2001 |
| WO | WO 01/07703 | A1 | | 2/2001 |
| WO | WO 01/07704 | A1 | | 2/2001 |
| WO | WO 01/16271 | | | 3/2001 |
| WO | WO 01/23295 | A2 | | 4/2001 |
| WO | WO 01/25526 | A1 | | 4/2001 |
| WO | WO 01/25527 | A1 | | 4/2001 |
| WO | WO 03/069042 | | | 8/2003 |
| WO | WO 03/069043 | | | 8/2003 |
| WO | WO 2004/044303 | A1 | | 5/2004 |

* cited by examiner

DISPENSING OF RINSE ADDITIVES INTO THE RINSE CYCLE DURING AUTOMATIC MACHINE LAUNDERING OF FABRICS

CROSS REFERENCE TO RELATED APPLICATIONS

This application claims priority under 35 U.S.C. § 119(e) to U.S. Provisional Application Ser. No. 60/356,544, filed Feb. 13, 2002.

TECHNICAL FIELD

The present invention relates to systems, methods, devices and kits for adding separate rinse additive materials to the drum (tub) of an automatic fabric laundering (washing) machine during the rinse cycle of its operation. The separate rinse additive materials themselves are packaged in a unit dose form which is inserted into a holder device (housing structure) within the washing machine drum in order to effect dispensing of the rinse additive materials into the washing machine drum at the appropriate time.

BACKGROUND OF THE INVENTION

There are a great many types of laundry additive materials suitable for use in automatic washing machines for fabric laundering. Cleaning agents such as surfactants and detergent builders are used to assist in the mechanical removal of soil and stains from fabrics being laundered. Bleaching agents, enzymes and adjuvants relating thereto are designed to promote chemical degradation and removal of soils and stains. Fabric conditioners, softeners, anti-wrinkle agents, soil release materials and similar agents serve to alter and enhance the condition, appearance or feel of laundered fabrics. Other auxiliary materials, such as pH adjustment and control agents, buffers, solvents, dispersants, anti-redeposition agents, dye transfer inhibitors, stabilizers, preservatives, perfumes, dyes and the like are used to alter the aqueous environment in the automatic washing machine drum to provide for optimum performance of the active laundry additive materials or to improve the quality or aesthetics of commercialized laundry products containing these active additive materials.

The several types of laundry additive materials described hereinbefore, frequently intermingled or admixed together in a wide variety of combinations for convenience, are commonly marketed to consumers in bulk quantities, in either solid, i.e., granular or tablet, or liquid form. To carry out the laundering operation, the consumer then adds aliquots of product as needed or desired from the bulk products into the automatic washing machine drum in appropriate amounts and at appropriate times during the laundering cycle.

It would be desirable, and a number of attempts have been made, to market fabric laundering products in "unit dose" form whereby aliquots of laundry additive materials are provided in pre-measured, pre-packaged form. The consumer can then conveniently add one of these unit dose aliquots to the automatic washing machine, e.g., into the drum, at the beginning of the laundry cycle and not have to measure product from bulk or add product to the cycle at different subsequent points in time.

Several factors complicate the provision of certain types of laundry additive materials in unit dose form. In the first place, some types and forms of laundry additives are not compatible with each other within a single concentrated product. Different types of materials may chemically interact with each other when admixed in concentrated form, thereby degrading and rendering one or both types ultimately ineffective for its intended purpose. Such incompatibility works against combining such materials together within a single unit dose product.

The major complicating factor in providing unit dose laundry products is that different types of laundry additives work best under different sets of conditions. Such different conditions are those which occur as the laundering operation progresses through its cycles which generally include washing and rinsing stages within the drum. The need therefore arises to add different types of laundry additives to the washing machine drum at different times during the laundering procedure. Most importantly, a number of types of fabric conditioners and softeners and other additives are best added to the rinse stages of the laundering operation. This is because many of these materials do not work in the way they are intended if they are present in the relatively high pH washing stages in the presence of chemically incompatible surfactants, builders, enzymes and other types of materials which perform their functions in the washing cycle(s). Thus even when provided in unit dose form, a number of materials which are typically thought of as rinse additives must be placed in the washing machine during the rinse cycle, well after the initial stages of the laundering operation have begun. This can create the need for the consumer to return to the washing machine at the beginning of the rinse cycle to add the materials which are to function during the rinsing operation.

A number of attempts have been made to permit the consumer to place rinse additive materials into devices or dispensers at the beginning of the laundering operation with those devices or dispensers serving to add the rinse additives to the rinse cycle automatically. Rinse addition can thus occur without further consumer involvement when the rinse cycle is reached later in the laundering operation. Many of such devices and dispensers operate by having their dispensing action activated by the centrifugal force. Centrifugal force, of course, arises as a consequence of the spin cycle in the machine laundering process. A fast spin cycle generally follows the washing step and serves to drain the washing machine drum of wash water prior to the addition of rinse water for the rinse cycle which follows the spin cycle.

Use of centrifugal force activated devices, dispensers or packages for delivery of rinse additives to the rinse cycles in an automatic laundering machine operation is not without its difficulties. In the first place, it is not simple or straightforward to fashion such devices, dispensers or packages in a way such that they are useful with or as unit dose packages of rinse additives. In the second place, systems utilizing unit dose packages of rinse additives must be designed so that the unit dose can survive the stresses and rigors of the washing stages of the laundering operation while remaining unopened and intact. Finally, the centrifugal force-activated dispensing means for the unit dose must be configured so that the unit dose of rinse additives is not added to the washing machine drum too soon after the spin cycle begins. If the rinse additive contents of the unit dose are released into the drum too early, much of these contents are lost with the wash water being drained from the drum during the spin cycle.

Given the foregoing difficulties in formulating unit dose products for use as rinse additives, it is an objective of the present invention to provide a system which can effectively utilize rinse additive products in unit dose form to deliver rinse adjuvants to the drum of an automatic fabric laundering machine during the rinse stage of its operational cycle. Such an objective is realized by providing a unit dose in the form of a certain type of rigid or flexible package. Such a package is then placed as an insert into a certain type of housing device which is positioned within the washing machine drum and which serves to bring about the desired manner and timing of dispensing of rinse additives into the washing machine drum for the rinse cycle.

BACKGROUND ART

Devices which can dispense laundry additive materials into one or more stages of a machine laundering operation are disclosed in U.S. Pat. No. 4,186,573 and PCT Publication WO 01/25526. Products in the form of a pouch or container which can be used for the staged or delayed dispensing of laundry additive materials into a machine fabric laundering operation are disclosed in U.S. Pat. Nos. 4,026,131; 4,260,054; and 4,588,080; and in Canadian Patent 1,133,712. Arrangements involving a dispensing device and a pre-packaged amount of laundry additive material for staged or timed dispensing during a laundering operation are disclosed in U.S. Pat. Nos. 4,379,515 and 4,882,917 and in PCT Publications WO 01/07703 and WO 01/07702.

SUMMARY OF THE INVENTION

In its system aspects, the present invention is directed to an arrangement of mechanical elements which provides for the timed dispensing of rinse additive materials into the rinse stage of the laundering cycle which occur during the operation of a drum-containing automatic fabric laundering machine. Such an arrangement comprises a rigid housing structure positioned within the washing machine drum, a unit dose package which can be placed as an insert within the housing and which contains the rinse additive materials to be dispensed into the washing machine drum, means for opening the insert to permit the release of its contents into the housing structure and means for permitting flow of the emptied rinse additive materials from the housing structure into the washing machine drum.

The rigid housing structure is positioned within the washing machine drum in a location which brings it into significant contact with rinse water in the drum during the laundering operation. Typically the housing structure will be attached to the inner circumferential wall of the washing machine drum.

The unit dose insert package can be placed within the housing structure at the beginning of the laundering operation. This insert may be flexible or rigid and can comprise one or more separate compartments. At least one compartment of the insert must contain the rinse additive material which is to be eventually added to the contents of the washing machine drum during the rinse stage of the laundering cycle.

The system herein also comprises means associated with either the housing structure or with the insert or with both to open at least the rinse additive-containing compartment of the unit dose insert. The opening of this compartment occurs after initiation of the spin cycle of the washing machine operation, and the means for opening this compartment of the insert are activated by the centrifugal force which arises as a consequence of running through the spin cycle during the operation of the washing machine. The opening of the rinse additive compartment(s) of the insert permits the emptying of the compartment contents within the housing structure. These emptied or emptiable contents are then held within the housing structure by the spin cycle centrifugal force.

Finally the system herein comprises aperture means, e.g., holes, associated with the housing structure. The purpose of such housing structure aperture means is to permit the gravitational flow of the rinse additive materials from the housing structure into the rinse water in the washing machine drum after cessation of the spin cycle centrifugal force.

In its method aspects, the present invention relates to the procedure of using the system described hereinbefore to bring about the appropriately timed dispensing of rinse additive materials into the rinse stage of the laundering cycle during the operation of a drum-containing automatic washing machine for fabric laundering. Such a method comprises first positioning the rigid housing structure hereinbefore described within the drum of the automatic washing machine in a location which will bring the housing into significant contact with rinse water during the rinse cycle stage. Then, a unit dose package as hereinbefore described and containing rinse additive material to be dispensed is placed as an insert into the housing structure at the beginning of the laundering operation. As noted, such an insert contains at least one compartment holding rinse additive material which is to eventually be added to the contents of the washing machine drum during the rinse stage of the laundering cycle.

The automatic washing machine is then run through its operational cycle, including its spin cycle, to thereby activate via centrifugal force from the spin cycle the insert opening means associated with the housing structure and/or with the unit dose insert package. This spin cycle serves to open the compartment(s) of the insert containing rinse additive material, thereby enabling the emptying of such contents from the unit dose insert. Such contents are then held within the housing structure by the same ongoing spin cycle centrifugal force which activates the insert opening means. Finally the washing machine cycle is continued through to its rinse cycle which removes the spin cycle centrifugal force from the housing structure and permits rinse additive material from the insert to pass by gravitational flow through the aperture means in the housing structure and into the rinse water then entering the washing machine drum.

In its device aspects, the present invention relates to a dispensing device which is an embodiment of the rigid housing structure of the type hereinbefore described. It is this dispensing device which is to hold the unit dose package insert as hereinbefore described and bring about the timed addition of rinse additive materials from the insert into the washing machine drum during the rinse cycle.

The device is in the form of a housing structure which must be rigid and suitable for holding an openable unit dose package containing the rinse additive material. The structure must also have an opening which is suitable for permitting insertion of the openable rinse additive unit dose package into the housing structure.

Further the housing structure devices herein must have means for positioning and securing the structure against the inner wall of the drum of the automatic washing machine in which it is to be used. Such means must be suitable for securing the housing structure in a position such that it will be subjected to centrifugal force arising during the washing machine spin cycle. In such a position, the structure must also be capable of holding and retaining within it, by virtue of that centrifugal force, any rinse additive material emptied or emptiable from the openable unit dose insert package once the insert has been opened.

Finally, the housing structure devices must contain aperture means therein placed in the housing structure in such a manner as to permit emptied or emptiable rinse additive contents of the opened insert to pass by gravitational flow through such aperture means and into the rinse water present in the washing machine drum during the rinse cycle. This gravitational flow occurs after cessation of the centrifugal force at the end of the spin cycle and the beginning of the rinse cycle. Preferably also the housing structure devices herein will further contain means, such as puncturing or rupturing knives, which will open the unit dose insert package placed therein, upon activation of those opening means by spin cycle centrifugal force.

In its "kit" aspects, the present invention relates to combinations of items which can be provided or sold together in order to facilitate assembly and use of the rinse additive material dispensing systems herein and the practice of the methods of this invention. Thus such kits can comprise the combination of the unit dose insert package as hereinbefore described and the rigid housing structure also as hereinbefore described. Such kits can also comprise the unit dose package inserts in combination with instructions on how to use such inserts with a pre-existing rigid housing structure in order to assemble the laundry additive dispensing systems herein or in order to carry out the methods-of-use herein.

DETAILED DESCRIPTION OF THE INVENTION

Figure 1:
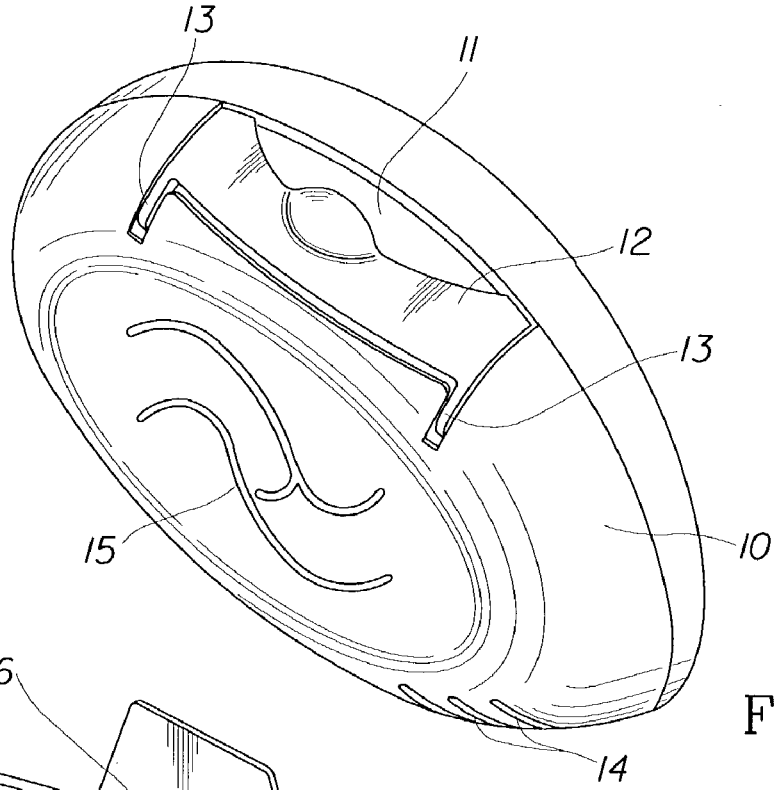
FIG. 1 of the drawings represents a rigid housing structure which can hold a unit dose package insert of rinse additive material.

Dispensing of laundry rinse additive materials in accordance with this invention takes place in a conventional automatic washing machine useful for the laundering of fabrics. Such automatic washing machines are those typically found in the home or in businesses such as self-service laundromats wherein individual consumers can launder their own loads of fabrics.

Automatic washing machines of the "North American" configuration typically utilize an upright or vertical drum or tub into which fabrics to be laundered are placed. Fabrics and laundry additives are added into the washing machine tub or drum, which is usually cylindrical, from the lidded top of the machine and are thus generally referred to as "top-loading" machines. Such North American style machines will frequently utilize a vertical agitator element placed along the axis of the drum. Rotation and vertical motion of the agitator serves to intensify the contact of fabrics in the drum with wash and rinse water in the drum. Japanese washing machines are typically similar in configuration to the North American machines.

Automatic washing machines of the "European" configuration commonly utilize a drum or tub, also generally cylindrical, which is positioned with the drum axis sideways or in a horizontal position. Fabrics and laundry additive materials are placed into the tub or drum of a washing machine of this configuration though a door on the front wall of the machine and are thus generally referred to as "front-loading" machines. Automatic washing machines of the European configuration typically do not utilize an agitator device or element.

Both North American and European automatic washing machines utilize a cycle of operation wherein the machine goes through a series of steps in which water is added, contacted with fabrics being laundered and then removed from the washing machine drum. Thus after fabrics are added to the drum, the first step in the laundering cycle is usually a washing step wherein significant amounts of water are added to the drum. The washing step involves a period wherein the fabrics being laundered are contacted with substantial amounts of water, generally with agitation or rotation of the drum. Water in the washing step will usually contain the primary laundry wash additives such as surfactants, builders, bleaches and/or enzymes which assist in and promote the removal of soil and stains from the fabrics being laundered.

At the conclusion of the washing step, water is removed from the washing machine drum. Frequently, this is brought about by gravity flow of wash water from the drum through appropriate valve configurations. Generally wash water is also removed by means of centrifugal force brought about by the drum rotating rapidly in a spin cycle. This centrifugal force moves water in the drum through holes or apertures in the circumferential walls of the drum. These holes lead to drainage means which can be opened and shut.

After the initial spin cycle, clean water is added back to the drum in a rinse cycle. Secondary laundry rinse additives such as fabric softeners or conditioners are generally contacted with the fabrics being laundered during the rinse cycle. Washing machine operation may also involve several additional spinning and rinsing cycles.

The present invention relates to the time specific dispensing of laundry rinse additive materials into the drum of an automatic washing machine as that machine is used for fabric laundering operations. For purposes of this invention, "laundry rinse additive materials" or simply "rinse additives" can comprise any solid or liquid materials which are conventionally added to the automatic washing machine drum during the rinse cycle of the fabric laundering procedure. Thus the list of suitable "laundry rinse additive materials" includes, but is not limited to, fabric softeners and conditioners, bleaches, enzymes, bleach and enzyme stabilizers, bleach and enzyme activators, aqueous and non-aqueous solvents, pH adjustment and control agents, dye transfer inhibitors, preservatives, anti-microbial agents, soil release agents, anti-wrinkle agents, chelating agents, optical brighteners, perfumes, pro-perfumes, dyes, and carriers.

Although there may be some overlap in the two classes of materials, "rinse additive materials" as used herein will generally be different and distinct from "laundry wash additive materials" or "wash additives" which may also be added to the laundering procedure, in addition to "rinse additive materials" in connection with some embodiments of the present invention. "Wash additive materials" will generally refer to any solid or liquid materials which are conventionally added to the automatic washing machine drum, along with fabrics being laundered, during the wash cycle of the laundering procedure. The wash cycle typically occurs at the beginning of the laundering operation. Most commonly, wash additive materials can include, but are not limited to, primary cleaning agents such as detersive surfactants and detergent builders, chelating agents, anti-redeposition agents, dispersants, suds suppressors, suds boosters, and some of the same kinds of cleaning agents like bleaches and enzymes and adjuvants therefore which may also be used as rinse additives. A more detailed description of various laundry additive materials of both the rinse and wash variety can be found in WO 00/02982 and WO 00/02987.

The system, methods, devices and kits of the present invention are intended to provide timed dispensing of laundry rinse additive materials into the laundering process from a single unit dose package which contains such additives. Such rinse additive materials are dispensed into the washing machine as the machine proceeds through its operational spin and rinse cycles as hereinbefore described. This is accomplished using a rigid housing structure which is positioned within the machine and which holds and preferably opens a unit dose package containing the rinse additive materials to be dispensed. Ideally the unit dose used herein can be used to deliver from 10 to 50 grams, preferably from 15 to 35 grams, of laundry rinse additives to one or more "rinse" cycles of an automatic washing machine laundering operation.

The rigid housing structure used in the instant invention must be positioned within the washing machine drum throughout the wash, spin and rinse cycles. Generally, the rigid housing structure will be positioned within the washing machine drum in a location such that it will be in contact with the rinse water in or being added to the drum during the rinse cycles of the laundering operation.

Positioning of the rigid housing structure may be accomplished by attaching the housing to some specific point within the washing machine drum. Alternatively, the housing may be positioned by utilizing an unattached structure which is of such a shape or configuration that it suitably positions itself within the washing machine drum as a consequence of the forces it encounters during the laundering operation, or at least during the spin and rinse cycles.

Preferably, at the beginning of the laundering operation, the housing structure will be attached to some specific spot within the washing machine drum wherein it will stay during the entire laundering cycle. The housing structure may be positioned on or near the washing machine agitator (if there is one) or may be positioned on the floor (top loaders) or rear wall (front loaders) of the drum. Most preferably, however, the rigid housing structure will be affixed to the inner circumferential wall of the washing machine drum in a position so that at least at some point during the rinsing cycles it is in contact with water used in the cycle. For North American washing machines, this position will preferably be below the fill line for rinse water in the drum.

The rigid housing structure may be of any suitable shape or configuration so long as it has an open inner volume within which the unit dose insert package can be placed and carried. The function and purpose of the rigid housing structure is to protect the integrity of the rinse additive unit dose package during the wash cycle(s) and to act as a receptacle for the contents of the unit dose package once that package has been opened during the spin cycle. Accordingly, the rigid housing structure will substantially surround the unit dose package once that package has been inserted into the housing. This may entail provision of an opening in the housing structure fitted with a lid which can be opened in order to permit insertion of the unit dose package and closed after the unit dose package has been inserted into the housing structure. Alternatively, the structure may comprise a base with a hinged cover that opens and closes to permit introduction of and subsequent protection for the unit dose insert.

Since the function and purpose of the housing structure is to protect the unit dose package it carries during the wash cycle(s), the structure must be "rigid." For purposes of this invention, a housing structure is "rigid" if it does not deform sufficiently to prematurely rupture or otherwise open the unit dose insert it carries as a consequence of forces or stresses which it encounters during the wash cycle(s).

The rigid housing structure can be fashioned from any suitable solid material including plastic, metal, ceramic, wood, etc. so long as the structure maintains its configuration and mode of operation through the laundering cycle and in contact with the wash and rinse water used and with the laundry additive materials released from the opened unit dose insert. Preferably the rigid housing structure will be fashioned from thermoformed or injection molded plastic so that it can be readily and cost effectively mass-produced.

The rigid housing structure serves to carry a unit dose package, placed therein at the beginning of the laundering operation, through to the spin and rinse cycles. This unit dose insert package will comprise at least one compartment containing rinse additive materials which are to be dispensed into the washing machine drum during the rinse cycle. The means for opening this rinse additive-containing unit dose insert are activated by spin cycle centrifugal force as described in greater detail hereinafter. Accordingly, the rigid housing structure must also be configured to deal with the contents of the unit dose insert package once that package has been opened within the housing during the spin cycle.

Thus the rigid housing structure must also be configured to permit water to eventually enter the structure during the rinse cycle of the laundering operation and to permit the rinse additive contents of the opened insert to be dispensed from the structure into the washing machine drum. Most frequently this configuration will involve appropriately placed and positioned holes or apertures in the housing structure through which rinse water from the laundering operation can enter and leave and through which rinse additive materials from the opened insert can flow into the washing machine drum.

Finally, the rigid housing structure must also be configured to hold substantially all (at least 90% by weight) of the rinse additive contents of the spin-cycle opened insert within the rigid housing until the spin cycle is completed. Thus the centrifugal force which opens the rinse additive compartment(s) of the unit dose insert can also be used to hold the contents released from the opened compartment(s) within the structure, and even in some cases still within the opened compartment(s) of the insert, until the spin cycle is over. At the conclusion of the spin cycle, when the centrifugal force ceases, the contents of the opened inserts can then be allowed to flow from the structure, for example by gravity through holes in the "bottom" of the structure. Alternatively, upon cessation of the spin cycle centrifugal force, the released rinse additive materials can be washed from the structure, and into the washing machine drum, by rinse water then entering the housing. By having the structure hold the released rinse additive materials until the spin stops, the rinse additive material can thereby be kept from being washed out of the washing machine drum by being forced out of the drum through the drainage holes in the drum wall during the spin cycle.

The unit dose insert package itself must be sized and configured so as to work cooperatively with the rigid housing structure into which it fits and within which it is used. The unit dose insert will thus comprise at least one compartment for rinse additive materials which are to be dispensed into the rinse cycle during the course of the laundering operation. Of course, the unit dose insert may utilize more than one compartment for rinse additive materials. This may be useful when two rinse additive materials are incompatible with each other and may be desirably separately packaged until they are added to the washing machine drum. The unit dose insert may also optionally contain separate compartments for laundry wash additive materials if the unit dose and housing structure are configured to dispense wash additives as well as rinse additives.

Each compartment of the unit dose insert may be fashioned from water-insoluble materials, water-soluble materials or combinations of both types. Furthermore, some compartments of the insert may be made from water-insoluble materials while other compartments can be made from water-soluble materials. The compartments of the insert may also be flexible or rigid or have some compartments flexible and other compartments rigid.

If the unit dose insert, or compartment thereof, is to be rigid, it may be made from any conventional polymeric material which can be thermoformed or injection molded into a relatively rigid structure. Thus polyethylene, polypropylene, polystyrene or polyester (e.g., polyethylene terephthalate) may be used to form the unit dose insert. A polymer material should be chosen which has good heat stability, especially if the insert is to be utilized in European washing machines where water temperatures approach boiling. The material of the insert should also be inert to any chemicals which are present in the laundry additives which the insert is to deliver.

A preferred configuration for the unit dose insert comprises a thermoformed tub formed from water-insoluble plastic, such as for example, polypropylene or polyethylene. The tub can be sealed with a thin layer of puncturable or rupturable plastic or metal, e.g., aluminum, foil. In another preferred configuration, a pouch with the rinse additives may be flexible and fashioned from water-insoluble materials, e.g., polyethylene or polypropylene film. Either tub or pouch will, of course, contain sealed within the rinse additive materials to be dispensed from the opened insert package during the rinse stage of the laundering operation.

Either the rigid housing structure or the unit dose package insert to be placed within the housing or both must comprise some means to open the unit dose insert package at the appropriate point during the laundering cycle. Furthermore, these opening means must be activated by the centrifugal force which is applied to the unit dose insert during the spin cycle.

Most preferably, the rigid housing structure itself will comprise the means for opening an insert, preferably water-insoluble, held within it. These means for opening the unit dose insert are, as noted, to be activatable by the centrifugal force applied to the housing structure/insert assembly during and as a consequence of the spin cycle during operation of the washing machine being used. Thus, for example, the means for opening the rinse additive-containing unit dose package may comprise sharp protrusions, blades or knives which will impinge on the unit dose insert during the spin cycle. The unit dose insert can be kept from initially contacting these opening means (until the spin cycle), for example, by a hinged, spring-loaded or otherwise movable positioning plate or baffle within the housing structure. Such a baffle or plate will hold the unit dose insert in a position such that the insert does not, upon its initial placement in the housing structure, impinge upon the insert opening means. However, upon application of spin cycle centrifugal force, the insert can exert force on the positioning plate or baffle, overcome the forces holding it in its initial position and move the plate and itself into a position whereby the insert will be punctured by the impinging puncturing means.

In an alternative embodiment for use with a soluble or partially soluble unit dose insert, the opening means for the unit dose insert can comprise a movable housing structure element which will open holes in the housing structure upon application of the spin cycle centrifugal force. Water can then enter these opened holes during the subsequent rinse cycle, and this water can then dissolve or otherwise open the appropriately constructed and positioned unit dose insert or compartment thereof. This type of arrangement contemplates that the housing structure will be water-tight through the wash cycle and will not become water permeable until after the spin cycle opens it to incoming rinse water.

In another preferred embodiment herein, the unit dose insert itself, and not the housing structure, may contain the means for opening the insert compartment(s) containing rinse additive materials. These are the compartments to be opened by means of the centrifugal force applied to the insert during the spin cycle of the laundering operation. Such rinse additive compartments may thus contain a frangible seal which comes apart or opens as pressure on the contents of the compartment increases as a consequence of the centrifugal force applied during the spin. Of course, the means for opening the rinse additive compartment(s) must be present in association with at least one of the rigid housing structure or the unit dose insert itself so that, one way or another, the rinse additive compartment(s) will be opened at the appropriate time during the laundering operation.

Opening of the single or each of the several compartment (s) of the insert within the housing structure should permit most (at least 85% by weight), and preferably all, of the contents of the compartment so opened to be eventually combined with the rinse water present in the washing machine drum during the rinse cycle. Rinse water in the drum for any rinse cycle during which a rinse additive compartment is opened in the insert will typically eventually have added thereto from 5 to 50 grams, preferably from 15 to 35 grams, of rinse additive material as a consequence of the opening of the rinse additive compartment(s).

The rinse additive unit dose package of this invention may form part of a larger unit dose package which can contain, for example, wash additives to be added to the wash cycle of the laundering operation. Thus the rinse additive insert may be joined to a water-soluble second package containing wash additive materials. The rinse additive portion of the insert may be placed inside a housing structure as described herein while the water-soluble wash additive portion of the insert can be left outside the housing. As the washing machine drum fills, the soluble portion of the insert dissolves, thereby releasing wash additives into the wash. The rinse additive portion stays within the housing until the spin cycle wherein it too is opened according to this invention and its rinse additive contents subsequently dispensed into the rinse cycle.

In another embodiment, the rinse additive compartment may be just one of a multi-compartmented unit dose insert which contains wash additives in other compartment(s). Such a multi-compartmented insert may then be used with a housing structure configured to open both wash and rinse additive compartments and dispense their contents at appropriate times during the laundering operation. Insert and housing configurations of this type are described in the concurrently-filed U.S. Provisional Patent Application of Yousef Georges Aouad and Arthur Hampton Neergaard having U.S. Ser. No. 60/356,543 filed Feb. 13, 2002.

A rigid housing structure and a single rinse additive containing unit dose insert package and their relationship to each other for use in the systems and methods and kits herein are all illustrated further by the accompanying drawings. FIG. 1 of the drawings shows a rigid housing structure of the type utilized in connection with the present invention. Such a housing structure comprises a hollow shell 10 having an opening 11 through which a unit dose rinse additive package (not shown) can be inserted into the housing structure. The opening 11 has a lid 12 which is hinged at points 13 and which is shown in FIG. 1 in the closed position. The lid 12 can be opened to permit insertion of the unit does package or closed, as shown in FIG. 1, to further protect and keep in place the unit dose insert. The shell 10 has apertures 14 through which rinse additive material from the opened insert package can pass into the washing machine drum at the beginning of and during the rinse cycle. The shell 10 also has slits 15 which permit rinse water from the washing machine drum to enter the housing structure during the rinse cycle and help wash out the rinse additive contents from the opened unit dose insert package.

Figure 2:
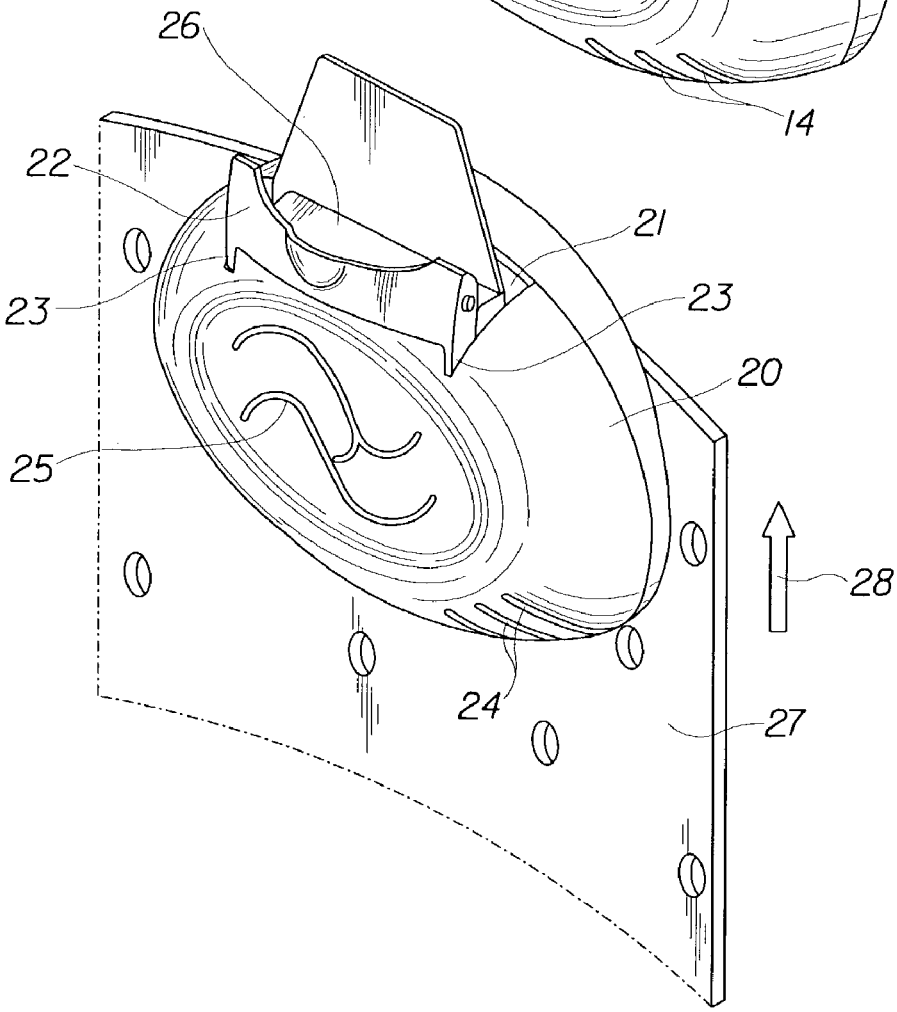
FIG. 2 of the drawings shows a rigid housing structure which can be utilized in the present invention, which is holding a unit dose insert package and which is positioned against the inside wall of a washing machine drum.

FIG. 2 shows the housing structure of FIG. 1 holding a unit dose insert package and positioned against the wall of a washing machine drum. In FIG. 2, the housing structure, as in FIG. 1, comprises a hollow shell 20 with an opening 21. The opening has a lid 22 hinged at hinge points 23 with the lid being shown in FIG. 2 in the open position. Inside the hollow shell 20 a flexible unit dose package 26 has been inserted. The whole assembly of housing structure and insert package is positioned against the wall 27 of a washing machine drum. As shown in FIG. 2, the washing machine drum is in the upright vertical position as indicated by arrow 28 which points toward the top of the washing machine. The housing structure has apertures 24 along the bottom of the shell 20 through which rinse additive material from the opened insert package can pass into the washing machine drum at the beginning of and during the rinse cycle. The shell 20 also has slits 25 which permit rinse water from the washing machine drum to enter the housing structure during the rinse cycle and help wash out the rinse additive contents from the opened unit dose insert package.

Figure 3:
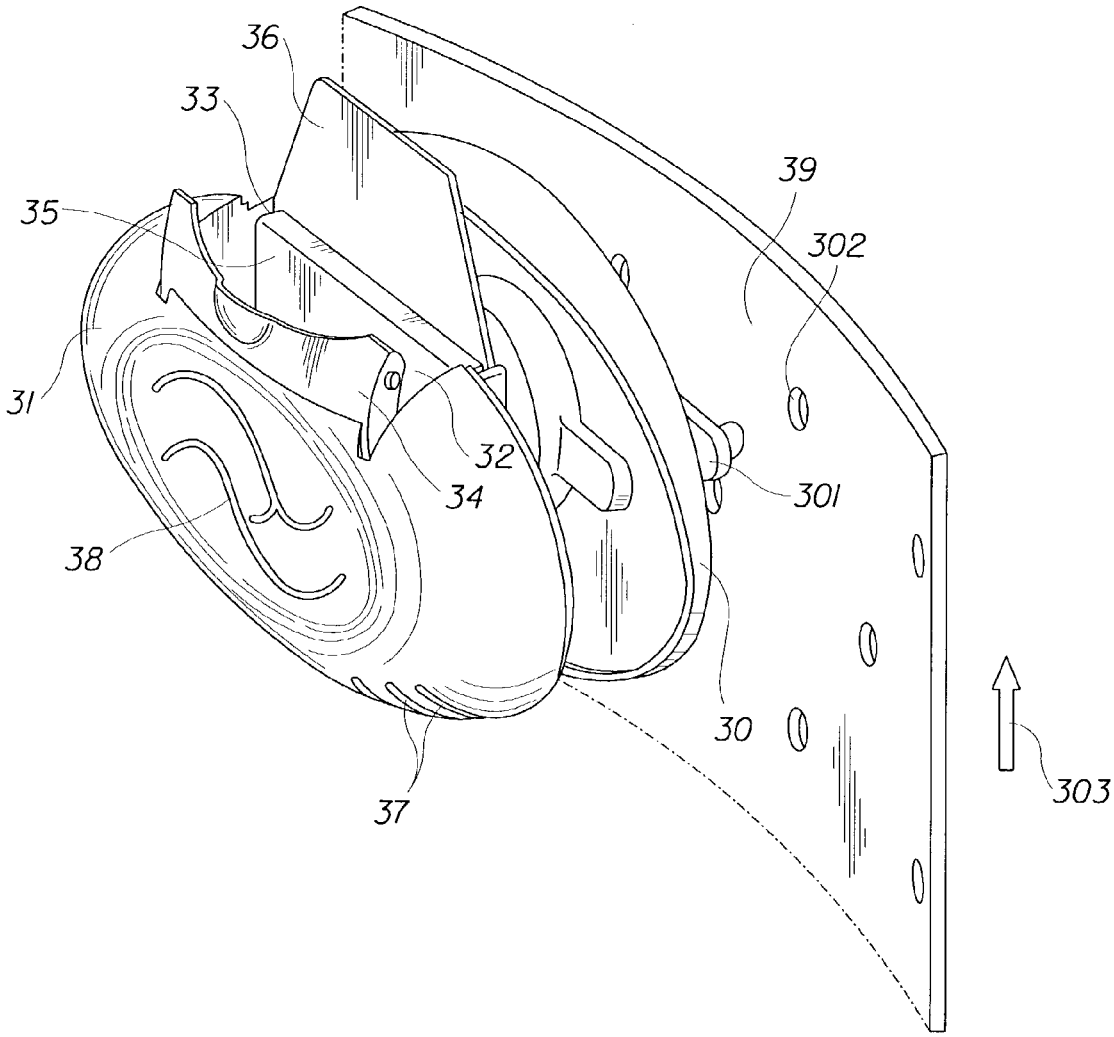
FIG. 3 of the drawings shows an exploded view of the FIG. 2 system, showing how the housing structure is constructed and attached to a washing machine drum.

FIG. 3 shows an exploded view of a housing structure which will hold a unit dose package as an insert and which can be attached to the wall of the washing machine drum. In FIG. 3 the housing structure comprises a base 30 and a cover 31, which in the completely assembled housing structure are joined together. A notch 32 in the cover forms an opening in the assembled housing structure through which a flexible unit dose rinse additive package 33 can be inserted into the housing structure. A hinged lid 34 can be closed to cover the opening once the unit dose package has been inserted into the hollow area of the housing structure.

The unit dose package itself has a flexible pouch 35 containing the rinse additive to be dispensed and a flap 36 attached to the pouch. The consumer can use the flap 36 to grip and hold the unit dose insert package. The flexible pouch 35 portion of the unit dose insert package is designed to rupture by means of a frangible seal (not shown). This frangible seal opens as a consequence of the pressure exerted by the pouch contents when such contents are subjected to the centrifugal force created by the washing machine spin cycle.

The housing structure has apertures 37 along the bottom of the cover 31 through which rinse additive material from the opened insert package 33 can pass into the washing machine drum at the beginning of and during the rinse cycle. The cover 31 also has slits 38 which permit rinse water from the washing machine drum to enter the housing structure during the rinse cycle and help wash out the rinse additive contents from the opened unit dose insert package.

The housing structure is attached to the wall 39 of the washing machine drum by means of a pegged attachment unit 301. The pegs of the attachment unit file into the holes 302 generally present in the circumferential inside wall 39 of the washing machine drum. As shown in FIG. 3, the washing machine drum is in the upright vertical position as indicated by arrow 303 which points toward the top of the washing machine.

Figure 4:
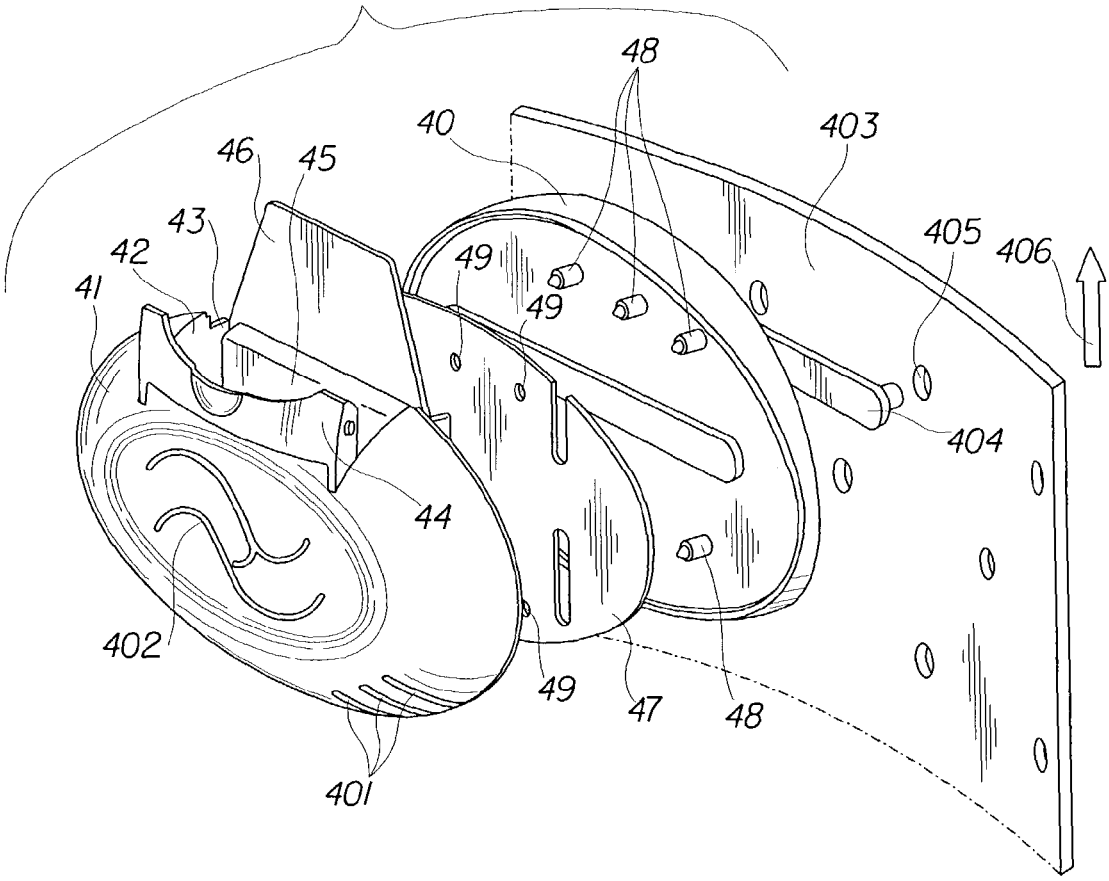
FIG. 4 of the drawings shows an exploded view of another type of rinse additive delivery system which utilizes a housing structure having associated with it means for opening the unit dose insert it holds.

FIG. 4 shows an exploded view of another type of housing structure for use in this invention. This embodiment of the housing structure has means associated with it for opening the insert it holds during the spin cycle of the machine laundering operation. In FIG. 4 the housing structure comprises a base 40 and a cover 41, which in the completely assembled housing structure are joined together. A notch 42 in the cover forms an opening in the assembled housing structure through which a flexible unit dose rinse additive package 43 can be inserted into the housing structure. A hinged lid 44 can be closed to cover the opening once the unit dose package has been inserted into the hollow area of the housing structure.

The unit dose package itself has a rigid thermoformed tub 45 containing the rinse additive to be dispensed. This tub 45 is sealed with a covering thin film (not shown) of rupturable oriented polypropylene. This film extends beyond covering the tub 45 and forms a flap 46 attached to the tub. The consumer can use the flap 46 to grip and hold the unit dose insert package.

Positioned between the area where the unit dose package is placed as an insert and the housing structure base 40 is a positioning plate 47 associated with the housing structure. This positioning plate 47 is attached to the structure base 40 by means of spring-loaded compressible spacer means (not shown). When no force is applied to it, the positioning plate 47 serves to keep the unit dose tub 45 away from puncturing means 48 which are associated with the housing structure base 40. During the spin cycle of the laundering operation, the spin cycle centrifugal force acting upon the unit dose insert tub 45 causes the tub to exert pressure on the positioning plate 47 which causes the positioning plate 47 to compress the spring loaded spacer means and to move toward the base 40 with its puncturing means 48. As the positioning plate 47 moves toward the base 40, the puncturing means 48 protrude through holes 49 in the positioning plate 47 and impinge upon the seal of the thermoformed tub 45. When the centrifugal force becomes great enough, the puncturing means 48 rupture the seal of the thermoformed tub 45 of the insert, thereby permitting the emptying of the rinse additive contents of the unit dose insert package.

The housing structure has apertures 401 along the bottom of the cover 41 through which rinse additive material from the opened insert package 43 can pass into the washing machine drum at the beginning of and during the rinse cycle. The cover 41 also has slits 402 which permit rinse water from the washing machine drum to enter the housing structure during the rinse cycle and help wash out the rinse additive contents from the opened unit dose insert package.

The housing structure is attached to the wall 403 of the washing machine drum by means of a pegged attachment unit 404. The pegs of the attachment unit file into the holes 405 generally present in the circumferential inside wall 403 of the washing machine drum. As shown in FIG. 4, the washing machine drum is in the upright vertical position as indicated by arrow 406 which points toward the top of the washing machine.

In another embodiment shown in FIGS. 6A–6C and FIGS. 7A–7C, an insert 50 such as that of FIGS. 7A–7C is inserted into a housing structure 51. The housing structure 51 comprises a base which includes a base plate 52 having side wall structure 53. A lid 54 for the housing structure 51 is attached to the base plate 52 via a hinge pin 75.

The base plate 52 comprises an attachment means (not shown) which is used to affix the housing structure 51 to the inside wall of a washing machine drum. The housing structure 51 is affixed to the washing machine drum in such a manner that the base plate 52 is parallel to the axis of the washing machine drum and is hence perpendicular to the direction of centrifugal force which arises during the washing machine spin cycle.

Figure 5A:
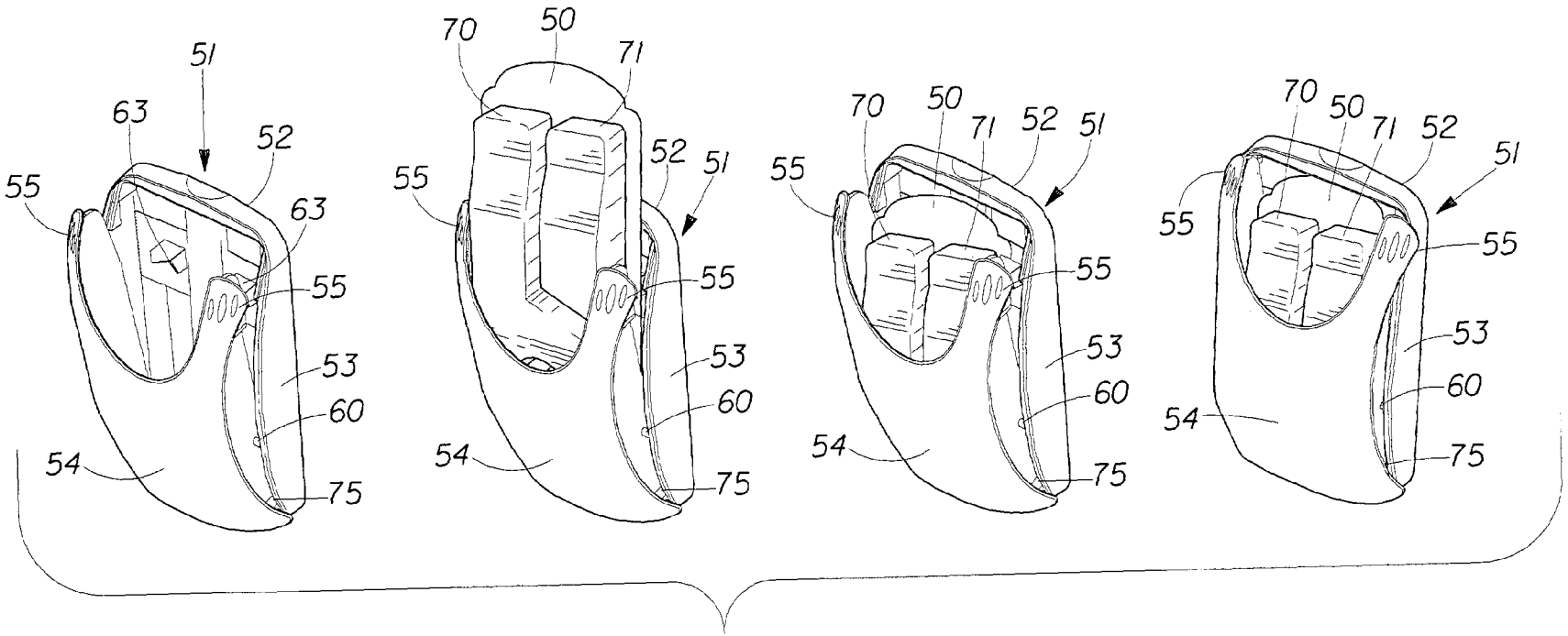
FIG. 5A of the drawings is a perspective view showing an embodiment of the housing structure and unit dose insert package of the present invention.
Figure 5B:
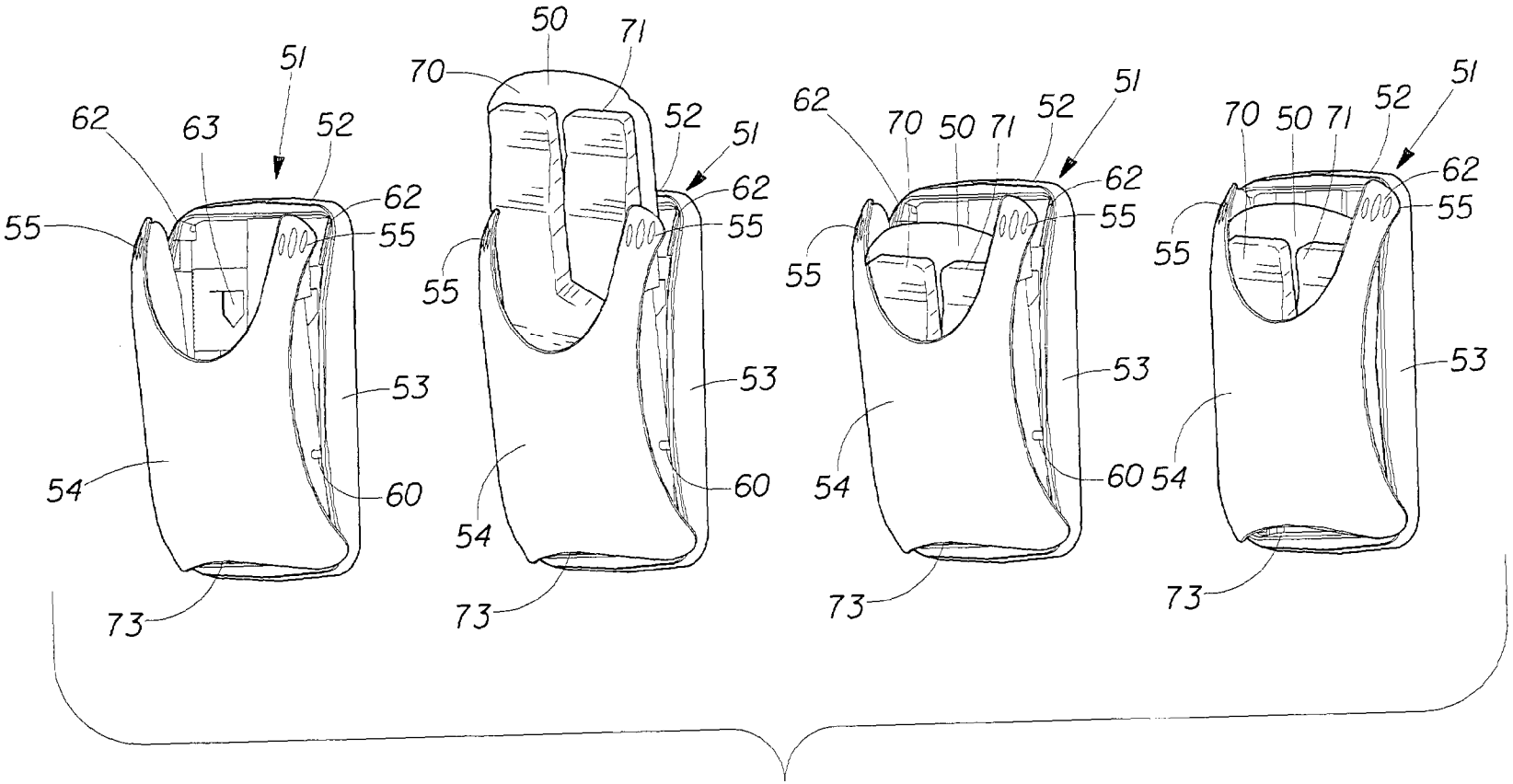
FIG. 5B of the drawings is a second perspective view of the embodiment of FIG. 5A.
Figure 5C:
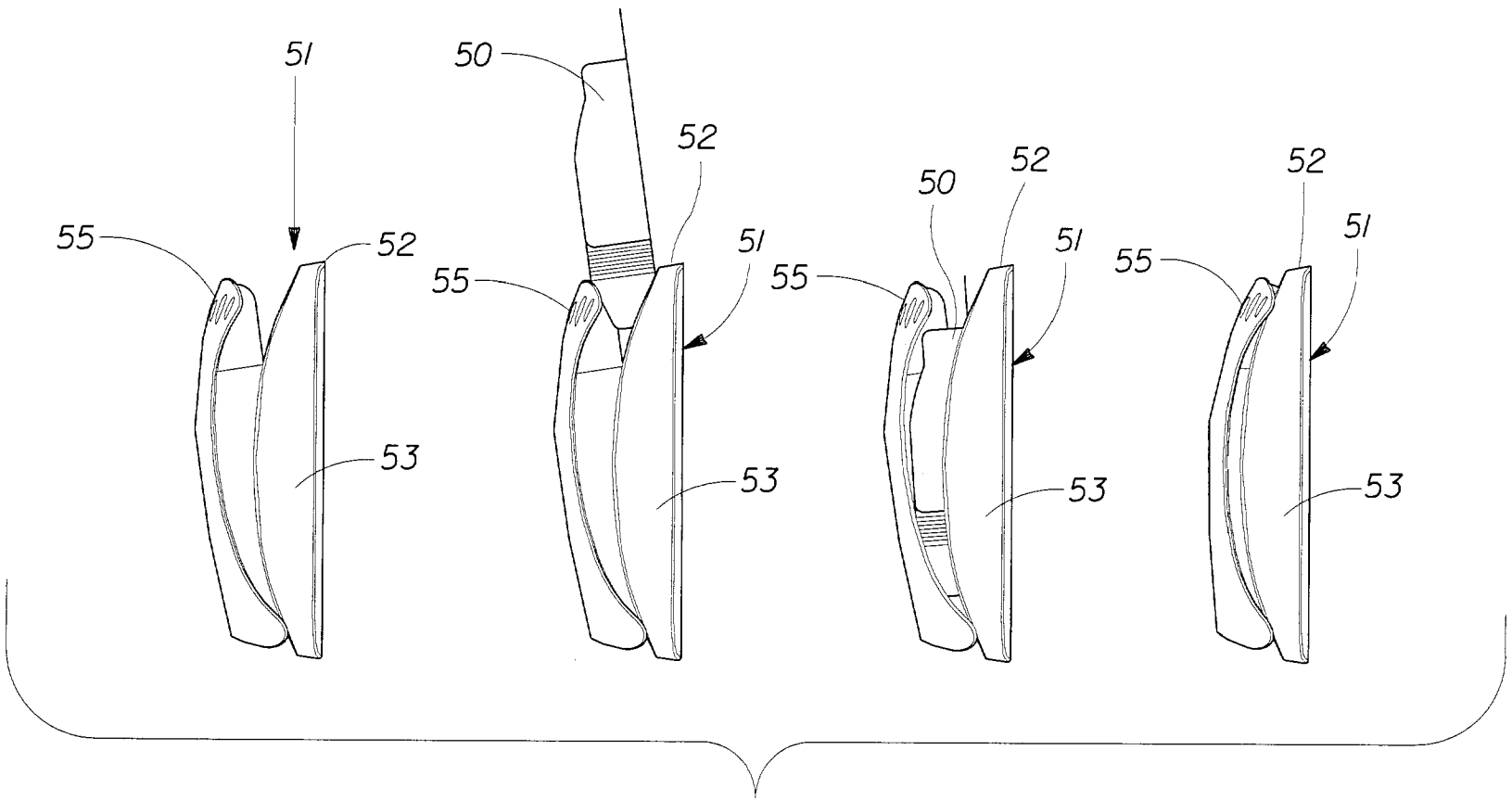
FIG. 5C of the drawings is a side view of the embodiment of FIG. 5A.
Figure 6A:
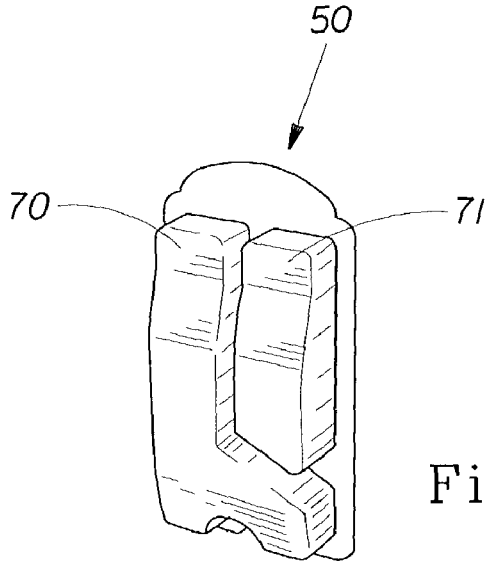
FIG. 6A of the drawings is a perspective view showing an embodiment of the unit dose insert package of the present invention.
Figure 6B:
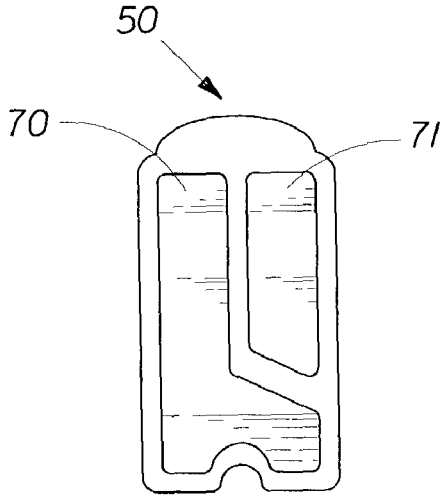
FIG. 6B of the drawings is a front view of the embodiment of FIG. 6A
Figure 6C:
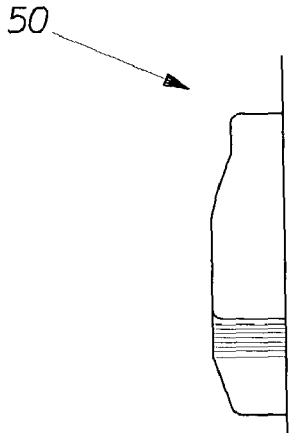
FIG. 6C of the drawings is a side view of the embodiment of FIG. 6A.

FIG. 5A shows a progression from left to right in the four drawings in which the housing structure 51 is shown in an open position followed with the insert 50 shown partially inserted into the housing structure 51, followed with the insert 50 shown fully inserted, and finally showing the insert 50 fully inserted with the lid 54 fully closed. FIGS. 5B and 5C show the same progression. Referring to FIGS. 6A–6C, the insert 50 is shown comprising two rinse additive compartments 70 and 71. The insert 50 is inserted into the housing structure 51 with the rinse additive compartments 70 and 71 positioned toward the hinge of the housing structure lid 54.

The lid 54 is opened by squeezing the ends 55 of the lid 54 and moving the lid 54 away from the base of the base plate 52. The lid 54 opens partially due to a lid stop 60 but far enough to accept the insert 50. The insert 50 is slid into the lid 54 so that when the lid 54 is closed, the latching mechanism 62 is engaged. As a consequence of closing and latching, the rinse additive compartments 70 and 71 of the insert 50 impinge upon puncturing means 63 associated with the base plate 52. This action punctures the rinse additive compartments 70 and 71 of the insert 50.

None of the contents of the rinse additive compartments 70 and 71 are dispensed as the resulting punctures are well above the contents contained within the rinse additive compartments 70 and 71. Later in the laundering operation, during the spin cycle, the centrifugal force generated by the spin cycle causes the rinse additive compartments 70 and 71 of the insert 50 to release their contents in the housing structure 51.

Rinse additives released by the centrifugal force of the spin cycle are held in the housing structure 51 until the spin cycle stops. The released rinse additives then flow by gravity through opening 73 at the bottom of the housing structure 51 and into the washing machine drum.

The method of using the above-described system for sequentially dispensing laundry additive materials into a fabric laundering operation can be illustrated by the following example:

EXAMPLE

A one-compartment unit dose insert is prepared having the general configuration of that shown in FIG. 4. The insert has a generally rectangular tub portion 45 which is fashioned from 0.381 mm thick polypropylene and is made by a thermoforming process. The tub portion 45 of the insert so formed is 11.0 cm long, 7.0 cm wide and 2.5 cm thick.

Approximately 30 grams of an aqueous liquid fabric softener composition are placed in the tub portion 45 of the FIG. 4 insert. Such a fabric softener composition comprises approximately 4.5% by weight of ditallowdimethyl ammonium chloride (DTDMAC) softener active plus minor amounts of perfume and silicone.

The insert, with the composition as hereinbefore described in its compartment, is sealed with a 0.0304 mm layer of oriented polypropylene film placed over the open compartment. This sealing film is extended beyond the edge of the tub 45 to form the flap portion 46 of the unit dose insert as shown in FIG. 4. The sealed unit dose insert package is then placed in a rigid lidded housing structure of the type also shown in FIG. 4. Prior to insertion of the unit dose package, this rigid housing structure is attached to the circumferential wall of the upright drum of a top-loading Kenmore 70 Series automatic washing machine. The housing is attached approximately 20 cm from the floor of the drum with the structure backplate 40 parallel to the circumferential wall 403 of the drum. The lidded opening 42 in the housing structure faces the top of the washing machine.

With the lidded housing structure in the open configuration, the unit dose insert is placed therein as shown in FIG. 4. Fabrics to be laundered are then placed in the washing machine. Just prior to starting the washing machine on its laundering cycle, the lid 44 of the housing structure is closed. The washing machine is then started on its cycle. Throughout the washing cycle, the insert is protected by the housing structure and remains intact with the film seal of its single compartment unbroken.

After a wash cycle of approximately 14 minutes, the washing machine begins its spin cycle to remove the wash water from the drum. The centrifugal force generated by this spin cycle serves to push the sealed rinse additive tub 45 (FIG. 4) of the insert within the housing against the positioning plate 47. This in turn moves the positioning plate back toward the housing base 40 such that the rinse additive rupturing means 48 which form part of the rigid housing base 40 begin to protude through the holes 49 in the positioning plate 47. This action eventually causes the seal of the rinse additive compartment 45 to rupture and release the fabric softener contents of the rinse additive compartment into the housing structure. The continuing centrifugal force of the spin cycle holds the released fabric softener composition in an area of the housing structure where there are no holes so that the released fabric softener rinse additive stays within the housing structure during the spin cycle.

After 2 minutes of the spin cycle, the spinning of the washing machine drum ceases and the drum begins filling with rinse water. At the same time, the rinse additive fabric softener composition which has been held within the housing structure during the spin cycle flows from the housing structure primarily through the holes 401 in the bottom of the housing cover 41 and into the rinse water. Rinse water in and entering the drum can also now enter the housing structure through slits 402 and wash out any residual fabric softener composition from the opened rinse additive tub 45. In this manner approximately 30 grams of the fabric softener rinse additive composition are introduced into the rinse water in the washing machine drum.

The rinse cycle continues for 5 minutes and thereafter the fabrics in the drum are wrung dry by a final spin cycle. Rinse additive from the insert has thus been delivered at the appropriate time to the rinse cycle during the laundering operation.

The rigid housing structure and the rinse additive insert packages therefor may be conveniently commercialized by marketing them in the form of kits. Thus the housing and insert which are to be used together in the systems and methods of this invention may be sold together, packaged as a unitary commercial kit product. Furthermore, the unit dose insert packages may be sold by themselves as refills for use in a rigid housing structure which the consumer may have previously purchased and has already installed on the washing machine to be used for practice of this invention. In the case of refills, the inserts can be marketed in combination with a set of instructions which describes the previously-purchased housing structure into which the unit dose fits and further describes the method of setting up and operating the housing/insert system in the consumer's automatic washing machine.

All documents cited are, in relevant part, incorporated herein by reference. The citation of any document is not to be construed as an admission that it is prior art with respect to the present invention. While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A system for providing laundry rinse additive material to rinse water during a rinse cycle which occurs during a fabric laundering operation carried out in a drum-containing automatic washing machine, which system comprises:

A) a unit dose package containing a laundry rinse additive material;

B) a rigid housing structure into which said additive-containing unit dose package can be inserted at the beginning of the laundering operation, said housing structure being positioned within the drum of said automatic washing machine in a location which brings it into significant contact with rinse water during the laundering operation;

C) means associated with said unit dose package or said housing structure or both to open said unit dose package, said opening means being activated by centrifugal force applied to said unit dose package during the spin cycle occurring in the operation of said automatic washing machine, whereby upon opening of said unit dose package the contents thereof can be emptied from said package into said rigid housing structure and held within said structure by said centrifugal force during said spin cycle; and D) aperture means associated with said housing structure for providing gravitational flow of said laundry additive material from said housing structure into said rinse water in said washing machine drum after cessation of said centrifugal force at the end of said spin cycle.

2. A system according to claim 1 wherein said rigid housing structure is attached to a specific spot within said washing machine drum where it stays for the duration of the laundering operation.

3. A system according to claim 2 wherein said insert contains one compartment for rinse additive material.

4. A system according to claim 2 wherein said insert contains two compartments for rinse additive material.

5. A system according to claim 2 wherein said compartment opening means associated with said housing structure comprises means for puncturing at least one of the compartments of said insert.

6. A kit comprising the combination of a rigid housing structure and one or more rinse additive-containing unit dose inserts as described in claim 5.

7. A system according to claim 2 which delivers from about 5 to 50 grams of rinse additive material to at least one rinse cycle during said fabric laundering operation.

8. A system according to claim 7 wherein, after cessation of the spin cycle, substantially all of the contents of the opened rinse additive compartment(s) of the insert flow into said washing machine drum through holes in said housing structure.

9. A system according to claim 1 wherein said insert is rigid and constructed from thermoformed polymeric material.

10. A system according to claim 1 wherein said insert is constructed at least in part from flexible polymeric material.

11. A kit comprising at least one rinse additive-containing unit dose insert in combination with a set of instructions describing the method of using said insert in the system of claim 1.

12. A method for introducing laundry rinse additive material into rinse water during a rinse cycle which occurs in a fabric laundering operation carried out in a drum-containing automatic washing machine, which method comprises:

A) providing a unit dose package containing a laundry rinse additive material;

B) inserting said additive-containing unit dose package into a rigid housing structure;

C) at the beginning of the operation of the automatic washing machine positioning said housing structure, with said additive-containing unit dose package therein, within the drum of said automatic washing machine in a location which brings it into significant contact with rinse water during the laundering operation;

D) running said automatic washing machine through its spin cycle to thereby apply centrifugal force to said additive-containing unit dose package within said housing structure, said centrifugal force serving to activate package opening means associated with said package or said housing structure or both, and to thereby open said package, release the contents thereof, and hold said contents within said rigid housing structure; and thereafter D) removing the centrifugal force from said opened package by ending the spin cycle during operation of said automatic washing machine; and thereafter E) allowing the laundry additive material within said rigid housing structure to pass by gravitational flow through apertures in said housing structure into the rinse water present in the drum during the rinse cycle in the operation of said automatic washing machine.

13. A method according to claim 12 wherein said rigid housing structure is attached to a specific spot within said washing machine drum where it stays for the duration of the laundering operation.

14. A method according to claim 13 wherein said insert contains one compartment for rinse additive material.

15. A method according to claim 13 wherein said insert contains two compartments for rinse additive material.

16. A method according to claim 13 wherein said compartment opening means associated with said housing structure comprises means for puncturing at least one of the compartments of said insert.

17. A method according to claim 13 which delivers from about 5 to 50 grams of rinse additive material to at least one rinse cycle during said fabric laundering operation.

18. A method according to claim 17 wherein, after cessation of the spin cycle, substantially all of the contents of the opened rinse additive compartment(s) of the insert flow into said washing machine drum through holes in said housing structure.

19. A method according to claim 12 wherein said insert is rigid and constructed from thermoformed polymeric material.

20. A method according to claim 12 wherein said insert is constructed at least in part from flexible polymeric material.

21. A rinse additive dispensing device suitable for positioning within a drum of an automatic washing machine for fabric laundering and suitable for dispensing laundry rinse additive material from a unit dose insert into the rinse water during the rinse cycle which occurs during a fabric laundering operation carried out in a drum-containing automatic washing machine, which device comprises:

A) a housing structure suitable for holding an openable unit dose package containing laundry rinse additive material;

B) an opening within said housing structure suitable for permitting insertion into said housing of said openable unit dose package containing said rinse additive material;

C) means for positioning said housing against the inner wall of the drum of said washing machine such that during the spin cycle of washing machine operation said housing is capable of holding and retaining, by virtue of centrifugal force applied during said spin cycle, the rinse additive material released from said openable unit dose package into said housing during said spin cycle; and;

D) aperture means placed within said housing in such a manner as to permit said released laundry additive material, after cessation of said centrifugal force, to pass by gravitational flow through said aperture means within said housing structure into the rinse water present in said drum during the rinse cycle in the operation of said washing machine.

22. A dispensing device according to claim 21 which further comprises means for opening at least one rinse additive-containing compartment of an insert placed therein, said opening means being activated by centrifugal force arising when said dispensing device is positioned within said washing machine drum during the spin cycle of said laundering operation.

23. A dispensing device according to claim 22 wherein all opening means comprise means for puncturing at least one of the compartments of the insert to be held within said housing structure.

* * * * *